United States Patent [19]

Kirchhoff

[11] Patent Number: 4,573,820

[45] Date of Patent: Mar. 4, 1986

[54] APPLICATOR TIP ASSEMBLY FOR A PEN-LIKE INSTRUMENT

[75] Inventor: Kenneth J. Kirchhoff, Gem Lake, Minn.

[73] Assignee: Minnesota Mining and Manufacturing Company, Saint Paul, Minn.

[21] Appl. No.: 627,288

[22] Filed: Jul. 2, 1984

[51] Int. Cl.[4] ..... B43K 3/04; B43K 7/10

[52] U.S. Cl. ..... 401/214; 401/260; 401/264

[58] Field of Search ..... 401/214, 264, 260

[56] References Cited

U.S. PATENT DOCUMENTS

| | | | |
|---|---|---|---|
| 225,810 | 3/1880 | Downes | 401/260 |
| 1,346,902 | 7/1920 | Lindahl | 401/260 |
| 2,228,540 | 1/1941 | Sturm | 120/43 |
| 3,188,266 | 6/1965 | Charbonneau et al. | 161/188 |
| 3.379,490 | 4/1968 | Schwartzman | 401/214 |
| 3,554,660 | 1/1971 | Woods | 401/214 |
| 3,676,574 | 7/1972 | Johansson et al. | 174/87 |
| 3,902,815 | 9/1975 | Williams | 401/264 |
| 4,198,172 | 4/1980 | Meislik | 401/214 |

FOREIGN PATENT DOCUMENTS

| | | | |
|---|---|---|---|
| 176302 | 3/1953 | Austria | 401/214 |
| 902352 | 12/1953 | Fed. Rep. of Germany | 401/214 |
| 1277703 | 9/1968 | Fed. Rep. of Germany | 401/214 |

*Primary Examiner*—Steven A. Bratlie

*Attorney, Agent, or Firm*—Donald M. Sell; James A. Smith; William L. Huebsch

[57] ABSTRACT

An applicator tip assembly including a body adapted to be secured to a fluid filled housing and having a through opening through which the fluid is dispensed and an applicator member positioned within the through opening and normally biased by a coil spring into sealing engagement against walls of the body defining an outlet for the through opening. The through opening in the body is partially defined by longitudinally extending radially inwardly projecting spaced fins, and the coil spring has a compressible portion between and guided for longitudinal movement by the fins ajacent the applicator member, and an anchor portion at the end of the compressible portion opposite the applicator member in firm thread-like engagement with the inner edges of the fins. Portion of the through opening defined between the fins afford easy passage of fluid around the spring in the through opening.

1 Claim, 7 Drawing Figures

APPLICATOR TIP ASSEMBLY FOR A PEN-LIKE INSTRUMENT

TECHNICAL FIELD

This invention relates to applicator tip assemblies for pen-like instruments used to apply liquids to substrates.

DISCLOSURE OF THE INVENTION

The present invention provides a simple and easily assembleable applicator tip assembly that can be used on pen-like instruments or the like to apply liquid to a substrate.

According to the present invention there is provided an applicator tip assembly comprising a body adapted to be secured to a liquid containing housing. As is known in the art, an applicator member positioned within the through opening is normally biased by spring means into sealing engagement against a wall defining an outlet for the through opening, and has a tip portion shaped to project through the outlet and past the end of the body when the application member is in engagement with the wall so that manual pressure applied through the housing to press the projecting portion of the applicator against a substrate will separate the applicator member from the housing against the bias of the spring means to allow fluid to flow around the applicator member and onto the substrate. Unlike the known prior art, however, in the tip assembly according to the present invention the through opening in the body is partially defined by longitudinally extending radially inwardly projecting spaced fins, and the spring means comprises an elongate coil spring having a compressible position between and guided for longitudinal movement by the fins adjacent the applicator member, and an anchor portion at the end of the compressible portions opposite the applicator member in firm engagement with the inner edges of the fins. This structure affords easy assembly of the spring in the body by simply pressing the spring between the fins, and portions of the through opening defined between the fins afford easy passage of the liquid around the spring in the through opening.

BRIEF DESCRIPTION OF THE DRAWING

The present invention will further be described with reference to the accompanying drawing wherein like numerals refer to like parts throughout the several views and wherein.

DETAILED DESCRIPTION OF THE PREFERRED EMBODIMENT

Figure 1:
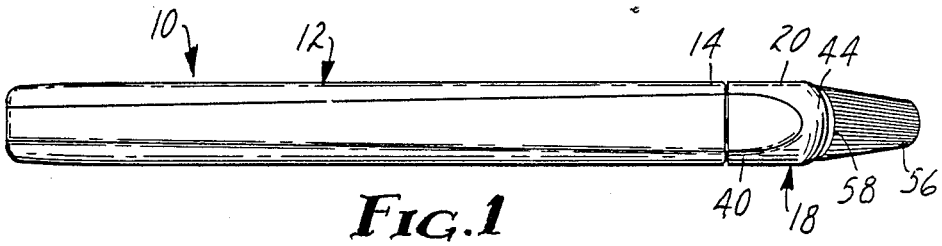
FIG.1 is a top view of a pen-like instrument for dispensing fluid including a tip assembly according to the present invention.
Figure 2:
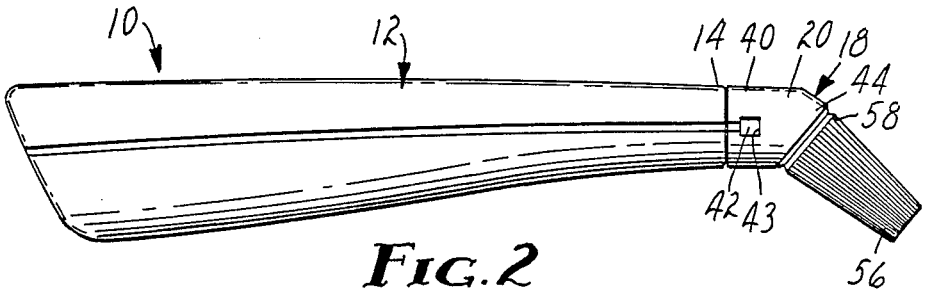
FIG. 2 is a side view of the instrument of FIG. 1.
Figure 4:
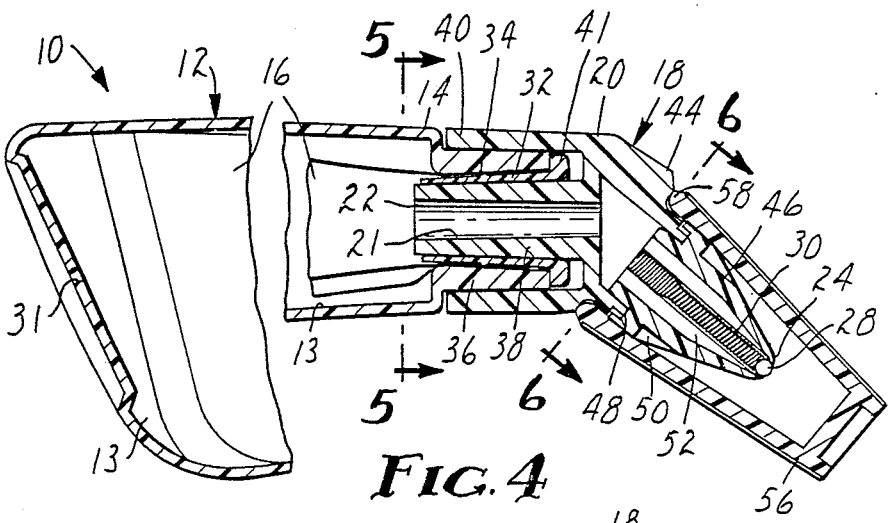
FIG. 4 is an enlarged fragmentary sectional view of the instrument of FIG. 1 including the tip assembly.
Figure 3:
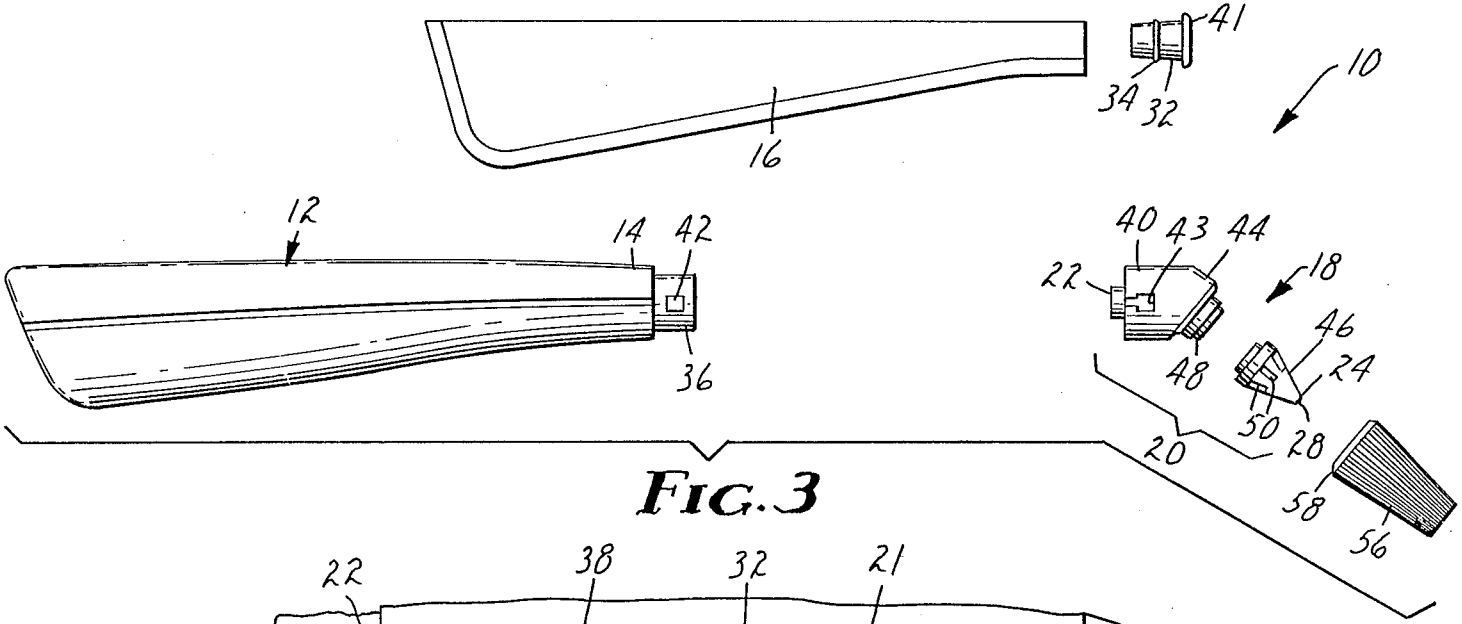
FIG. 3 is an exploded view of the instrument of FIG. 1.

Referring now to FIGS. 1 through 7 there is shown a pen-like instrument for dispensing correction fluid including a tip assembly 18 according to the present invention, which instrument is generally designated by the reference numeral 10. As is best seen in FIGS. 3 and 4, the instrument 10 comprises an elongate housing 12 having a cavity 13 opening through a first end 14 of the housing 12, and a bag 16 of thin flexible polymeric film material within the cavity 13, which bag 16 has an outlet opening at the first end 14 of the housing 12. The applicator tip assembly 18 comprises a two part body 20 (FIG. 4) having a through opening 21 with an inlet 22 in an inlet end of the body 20, and including an annular inwardly projecting lip 24 defining an outlet for the through opening 21 in an outlet end of the body 20. A spherical applicator member 28 is positioned within the through opening 21 and has a surface shaped to make sealing engagement against the lip 24 with a portion of applicator member 28 projecting through the outlet and past the outlet end of the body 20 when the surface of the applicator member 28 is in engagement with the lip 24. Spring means including a coil spring 30 are provided for biasing the applicator member 28 against the lip 24. Means later to be explained are provided for securing the body 20 to the housing 12 and for securing the bag 16 in liquid tight engagement to the body 20 with the outlet opening of the bag 16 communicating with the inlet 22 of the through opening 21 in the body 20 to retain correction fluid within the bag 16. Manual pressure applied through the housing 12 to press the projecting portion of the application member 28 against a substrate (such as a sheet of paper) and thereby separate the surface of the application member 28 from the lip 24 against the bias of the spring 30 will allow correction fluid to flow from the bag 16 around the applicator member 28 and onto the substrate, whereas when such manual pressure is released the applicator member 28 will again seal against the lip 24 to prevent escape of the correction fluid and evaporation of solvent from within the bag 16. As correction fluid flows from the bag 16, the bag 16 will contract, and the increasing space around the bag 16 within the cavity 13 will be filled with air that enters the cavity 13 through a vent opening 31 in an end wall of the housing 12.

The instrument 10 is especially adapted to dispense correction fluid capable of obscuring indicia made by typewriter ribbons, writing inks, and fused toner powders, all without either dissolving or smearing the indicia. Preferably the correction fluid comprises a nonflammable solvent system consisting essentially of, on a volume basis, (1) about 25–35% nonflammable fluorine-containing subsystem (e.g., trifluorotrichloroethane) and, correspondingly, (2) about 75–65% flammable aliphatic solvent subsystem (e.g., heptane). Also included in the preferred composition are a thermoplastic acrylate or methacrylate resin dissolved in the solvent system, a plasticizer for the resin, an effective amount of finely divided rutile titanium dioxide as an opacifying pigment, a bentonite gel as an anti-settling agent, and a wetting agent. Such a correction fluid has been found to resist settling and can be readily redispersed, even after extended standing, and is more completely described in U.S. patent application, attorneys file No. 40186 USA 4A filed concurrently herewith and incorporated herein by reference.

An air filled space is provided between much of the bag 16 and the housing 12, particularly around the bag 16 adjacent the tip assembly 18 where a user of the instrument 10 normally places his fingers. This air space greatly restricts heat transfer from the users hand to the correction fluid in the bag 16, which heat transfer could otherwise cause evaporation of solvent in the correction fluid resulting in excessive gas pressure to drive connection fluid from the bag 16 when the application member 28 is separated form the lip 24.

Figure 7:
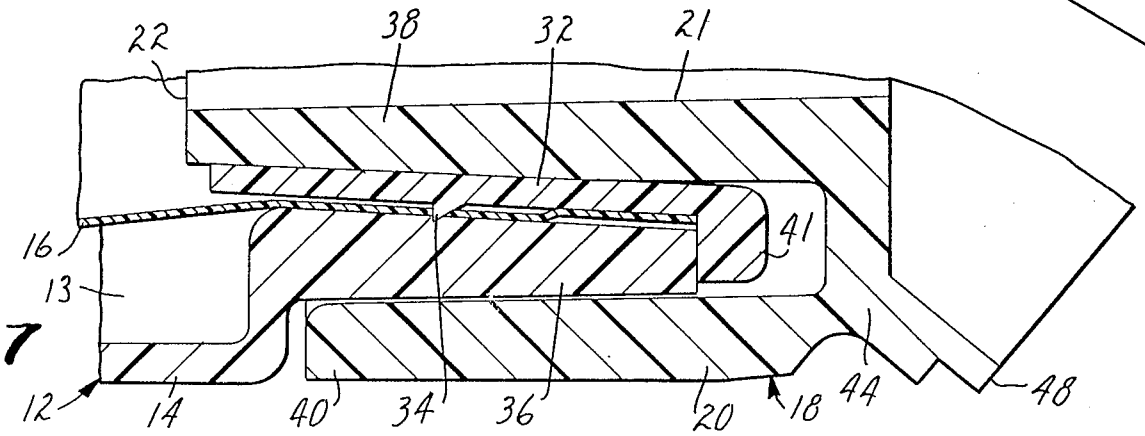
FIG. 7 is an enlarged fragmentary view of a means for sealing in the instrument of FIG. 1.

As is best seen in FIGS. 4 and 7 the means for securing the body 20 to the housing 12 and for securing the bag 16 in liquid tight engagement to the body 20 comprises a sleeve 32 having an annular outwardly projecting triangular tooth-like ridge 34 extending circumferentially around and partially defining its outer surface. The sleeve 32 is positioned within the outlet opening of the bag 16 with the bag 16 around the ridge 34, and the housing 12 has a portion 36 at its first end 14 with a cylindrical inner surface positioned around the part of the bag 16 over the ridge 34. The body 20 comprises a tubular support portion 38 with a frustro conical outer surface within and supporting an inner surface of the sleeve 32 against the bag 16 and cylindrical inner surface of the body 20 to provide a seal therebetween along the ridge 34. The body 20 further includes a collar 40 overlying the portion 36 of the housing 12 that defines the cylindrical inner surface and the support portion 38 of the body 20, which collar 40 helps to support the cylindrical inner surface of the housing 12 against which the ridge 34 presses the surrounding part of the bag 16. Interlocking means in the form of outwardly projecting barbs 42 on the housing portion 36 and walls defining sockets 43 on the collar 40 are provided to hold the housing 12 and the body 20 together.

The sleeve 32 is of a heat fusible material such as polyethylene, and the thin flexible material of the bag 16 comprises an inner layer of a material that is heat fusible to itself and to the sleeve 32 such as linear low density polyethylene. The inner layer of the bag 16 is heat fused to itself to form the bag 16 and is heat fused to the outer surface of the sleeve 32 around one of hte ridges 34 to help hold the bag 16 and sleeve 32 in position during assembly of the instrument 10, and to help provide the seal therebetween. Preferably before such fusing occurs the sleeve 32 has a projecting sacraficial ridge similar to the tooth-like ridge 34 extending circumferentially around its outer surface between the ridge 34 and an end flange 41 on the sleeve 32, which sacraficial ridge is melted during the fusing to help seal the bag 16 to the sleeve 32. The bag 16 also has an outer layer of a strong flexible material, such as polyester, which with the inner layer, provides chemical resistance to the solvent in the correction fluid. Preferably the inner layer of linear low density polyethylene is bonded to the outer polyester layer in accordance with the teachings in U.S. Pat. No. 3,188,266, incorporated herein by reference. Such a bonded two layer film may be available under the trade designation "X-28" from Minnesota Mining and Manufacturing Company, St. Paul, Minn.

The two parts that form the body 20 include an inner part 44 on which the support portion 36 and collar 40 are formed, and a generally conical tip part 46 on which the lip 24 defining the outlet opening is formed and in which the spring 30 and applicator member 28 are mounted. The end of the tip part 46 opposite the lip 24 is fused to an annular end surface 48 on the inner part 44, which fusion, can be caused by solvents or adhesion, or by heat caused by spinning the tip part 46 against the inner part 44. Such spinning is facilitated by axially aligned spaced grooves 50 around the outer surface of the tip part 46 which receive a chuck for spinning the tip part 46.

Figure 6:
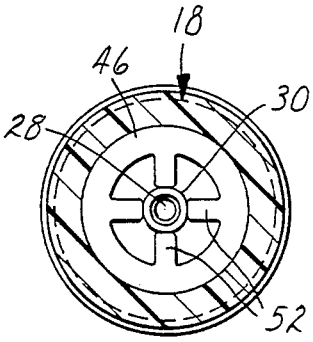
FIG. 6 is a sectional view taken approximately along line 6—6 of FIG. 4 which shows an end view of the tip assembly.

As is best seen in FIGS. 4 and 6, the portion of the through opening 21 provided by the tip part 46 is defined by longitudinally extending radially inwardly projecting spaced fins 52. The elongate spring 30 has a compressible portion between and guided for longitudinal movement by the portion of the fins 52 adjacent the applicator member 28. An anchor portion of the spring 30 at the end of its compressible portion opposite the applicator member 28 is in firm engagement with the inner edges of the fins 52 to anchor the spring 30 with its compressible portion pressed against the applicator member 28. This structure affords easy press in assembly of the spring 30 in the tip part 46 of the body 20 when the body parts 44 and 46 are separated, and portions of the through opening 21 defined between the fins 52 afford easy passage of the correction fluid around the spring 30 in the through opening 21.

The pen-like instrument 10 also includes a cap 56 adapted for releasable sealing engagement with the tip part 46 of the body 20 over the outlet end of the through opening 21, which engagement is provided by an annular distal lip 58 on the cap 56 being cammed into an interference fit in a mating groove around the tip part 46 by the adjacent outer surface of the tip part 46.

Figure 5:
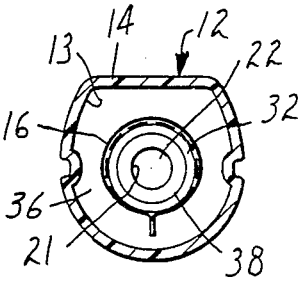
FIG. 5 is a sectional view taken approximately along line 5—5 of FIG. 4.

Preferably, as illustrated, the housing 12 has a generally uniform width and is tapered in height toward its first end 14, resulting in a generally circular cross section for the cavity 13 adjacent the tip assembly 18 (see FIG. 5). Also, preferably, the central axis of the distal portion of the tip assembly 18 is disposed at about a 40 degree angle with respect to the central axis of the housing 12 (see FIGS. 2 and 4). These features allow a user to comfortably grasp the housing 12 in the manner of a pen while having a clear view of the tip assembly so that correction fluid can be accurately placed on a substrate through the tip assembly 18.

I claim:

1. An applicator tip assembly for use in a pen-like instrument, said tip assembly comprising:

a body having an inlet end and an outlet end, having a through opening with an inlet in said inlet end, and an outlet in said outlet end;

an applicator member within said through opening having a surface shaped to make sealing engagement against said body at said outlet end and being shaped to project through said outlet and past the outlet end of said body when said applicator member is in engagement with said body; and spring means for biasing said applicator member against the outlet end of said body, wherein said through opening in said body is partially defined by longitudinally extending radially inwardly projecting spaced fins, and said spring means comprises an elongate coil spring having a compressible portion between and guided for longitudinal movement by said fins adjacent said applicator member, and an anchor portion at the end of said compressible portion opposite said applicator member in firm engagement with the inner edges of said fins, portions of said through opening defined between said fins affording easy passage of fluid around said spring in said through opening.

* * * * *